US006675755B2

(12) United States Patent
Glovatsky et al.

(10) Patent No.: US 6,675,755 B2
(45) Date of Patent: Jan. 13, 2004

(54) INTEGRATED POWERTRAIN CONTROL SYSTEM FOR LARGE ENGINES

(75) Inventors: Andrew Zachary Glovatsky, Plymouth, MI (US); Mark David Miller, Monroe, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/009,373

(22) PCT Filed: Apr. 6, 2001

(86) PCT No.: PCT/US01/11287

§ 371 (c)(1),
(2), (4) Date: Nov. 4, 2001

(87) PCT Pub. No.: WO01/79691

PCT Pub. Date: Oct. 25, 2001

(65) Prior Publication Data

US 2003/0084859 A1 May 8, 2003

Related U.S. Application Data

(60) Provisional application No. 60/195,077, filed on Apr. 6, 2000.

(51) Int. Cl.[7] ..... F02P 23/00
(52) U.S. Cl. ..... 123/143 C; 123/184.21
(58) Field of Search ..... 123/143 C, 184.21, 123/456, 198 E; 174/19, 17 R, 24, 31 S

(56) References Cited

U.S. PATENT DOCUMENTS 2,234,579 A * 3/1941 Robertson ..... 123/633
3,651,448 A * 3/1972 Pauza ..... 439/487
3,691,289 A * 9/1972 Rohloff ..... 174/52.2
3,693,252 A * 9/1972 Robertson et al. ..... 29/841
5,153,379 A * 10/1992 Guzuk et al. ..... 174/35 R
5,203,292 A 4/1993 Motose
5,207,186 A 5/1993 Okita
5,353,758 A 10/1994 Masuda et al.
5,477,819 A 12/1995 Kopec
5,501,205 A * 3/1996 Betz et al. ..... 123/635
5,713,322 A 2/1998 Mausner et al.
5,996,543 A 12/1999 Nakayama et al.
6,186,106 B1 2/2001 Glovatsky et al.
6,279,527 B1 * 8/2001 Glovatsky et al. ..... 123/143 C
6,357,414 B1 * 3/2002 Kalinowski et al. .... 123/198 E

FOREIGN PATENT DOCUMENTS

EP 0 913 571 A2 5/1999
WO WO 01/79691 A1 10/2001

OTHER PUBLICATIONS

De Vos, Delphi Automotive Systems, Driving Tomorrow's Technology, pp. 25–29.

* cited by examiner

*Primary Examiner*—Mahmoud Gimie
(74) *Attorney, Agent, or Firm*—Brinks Hofer Gilson & Lione

(57) ABSTRACT

A system for controlling a vehicle powertrain is disclosed. The system includes a powertrain circuit for receiving a plurality of powertrain operating signals, processing the operating signals, and outputting a plurality of powertrain control signals for controlling the vehicle powertrain, and an air-intake manifold fixable to an engine of the vehicle powertrain and adapted to receive the powertrain control circuit. The present invention provides a self-contained vehicle powertrain that is testable before installation into a motor vehicle.

25 Claims, 12 Drawing Sheets

INTEGRATED POWERTRAIN CONTROL SYSTEM FOR LARGE ENGINES

CROSS-REFERENCE TO RELATED APPLICATIONS

This application is a filing under 35 U.S.C. 371, which claims priority to International Application Ser. No. PCT/US01/11287, filed Apr. 6, 2001, which claims the benefit of Provisional application Ser. No. 60/195,077, filed Jun. 4, 2000.

FIELD OF THE INVENTION

The present invention relates to vehicle powertrains having integrated powertrain control systems mounted on the powertrain.

BACKGROUND ART

Typically engines, such as internal combustion engines, have an air intake manifold for drawing in air from outside the engine and directing the air into each engine cylinder. The outside air flows in through an air intake duct and into a central air chamber, from which it is then directed into individual runners or channels and into each individual engine cylinder where combustion takes place.

Generally, combustion is facilitated by activating a spark from a spark plug within the cylinder of a gasoline engine or by activation of a glow plug within the cylinder of a diesel engine. Such activation is generally accomplished by supplying either post or continuous electrical signals or power feeds to the spark plug or glow plug. These signals or power feeds in turn typically come from either a central distributor, or from individual ignition coils at each cylinder. In fuel injected engines, it may also be desirable to have an individual electronic fuel injector (EFI) disposed approximate each cylinder; these EFI's also require signals or power feeds, typically from a microprocessor-controlled subsystem.

The electrical distribution system required to facilitate these various signals and or power feeds conventionally requires a considerable network of wires, cables, harnesses, connectors, fasteners, brackets, standoffs, strain reliefs, and one or more support frames for arranging, routing, and supporting all of these elements. In addition, most engines nowadays also require various other electrical engine subsystems, such as engine control modules, mass air flow sensors, sensor modules, antilock brake control modules, and so forth. Each of these sub-systems also require its associated wires, harnesses, connectors, housings, fasteners, etc. further adding to the electrical distribution and routing system of the engine. All of these various sub-systems are necessary, they may each add to the overall weight, space, complexity and cost of the engine.

Therefore, it would be desirable to provide some means of accommodating the various signals and power feed needs of an engine system by reducing the overall weight, space requirements, cost, and complexity of the engine system.

SUMMARY OF THE INVENTION

The present invention overcomes the disadvantages of the prior art approaches by providing an system for controlling the operation of a vehicle powertrain. The system has a powertrain circuit for receiving powertrain a plurality of operating signals, processing the operating signals, and outputting a plurality of powertrain control signals for controlling the vehicle powertrain, and an air-intake manifold fixable to an engine of the vehicle powertrain and adapted to receive the powertrain control circuit.

In accordance with an embodiment of the present invention the powertrain circuit is a flatwire flexible circuit.

In accordance with another embodiment of the present invention the flatwire flexible circuit includes a flatwire lead for electrically coupling the powertrain circuit to an external device or circuit.

In accordance with yet another embodiment of the present invention a housing for securing the powertrain circuit thereto and providing environmental protection thereof is provided.

In accordance with yet another embodiment of the present invention the housing is substantially disposed within an interior of the manifold and in an air stream flowing through the manifold for convectively cooling the powertrain circuit.

In accordance with yet another embodiment of the present invention the powertrain circuit is adhesively bonded to the housing with a thermally conductive adhesive.

In accordance with yet another embodiment of the present invention the air-intake manifold includes a shelf for supporting the housing within an interior of the manifold.

In accordance with yet another embodiment of the present invention the air-intake manifold includes at least two rails for supporting the housing within an interior of the manifold.

In accordance with yet another embodiment of the present invention the housing includes an electrical connector affixed to the housing for electrically coupling the powertrain circuit to a circuit or device external of the housing.

In accordance with yet another embodiment of the present invention the powertrain circuit includes a processor for processing powertrain control logic for controlling powertrain operation.

In accordance with yet another embodiment of the present invention the air-intake manifold includes a heat sink fixed to the air-intake manifold for increasing thermal cooling of the powertrain circuit.

In accordance with still another embodiment of the present invention. An air-intake manifold fixable to an engine of a vehicle powertrain for directing intake air into the engine is provided. The manifold includes a powertrain circuit for receiving a plurality of powertrain operating signals, processing the operating signals, and outputting a plurality of powertrain control signals for controlling the vehicle powertrain.

These and other advantages, features and benefits of the invention will become apparent from the drawings, detailed description and claims which follow.

DETAILED DESCRIPTION OF THE PREFERRED EMBODIMENTS

Figure 1:
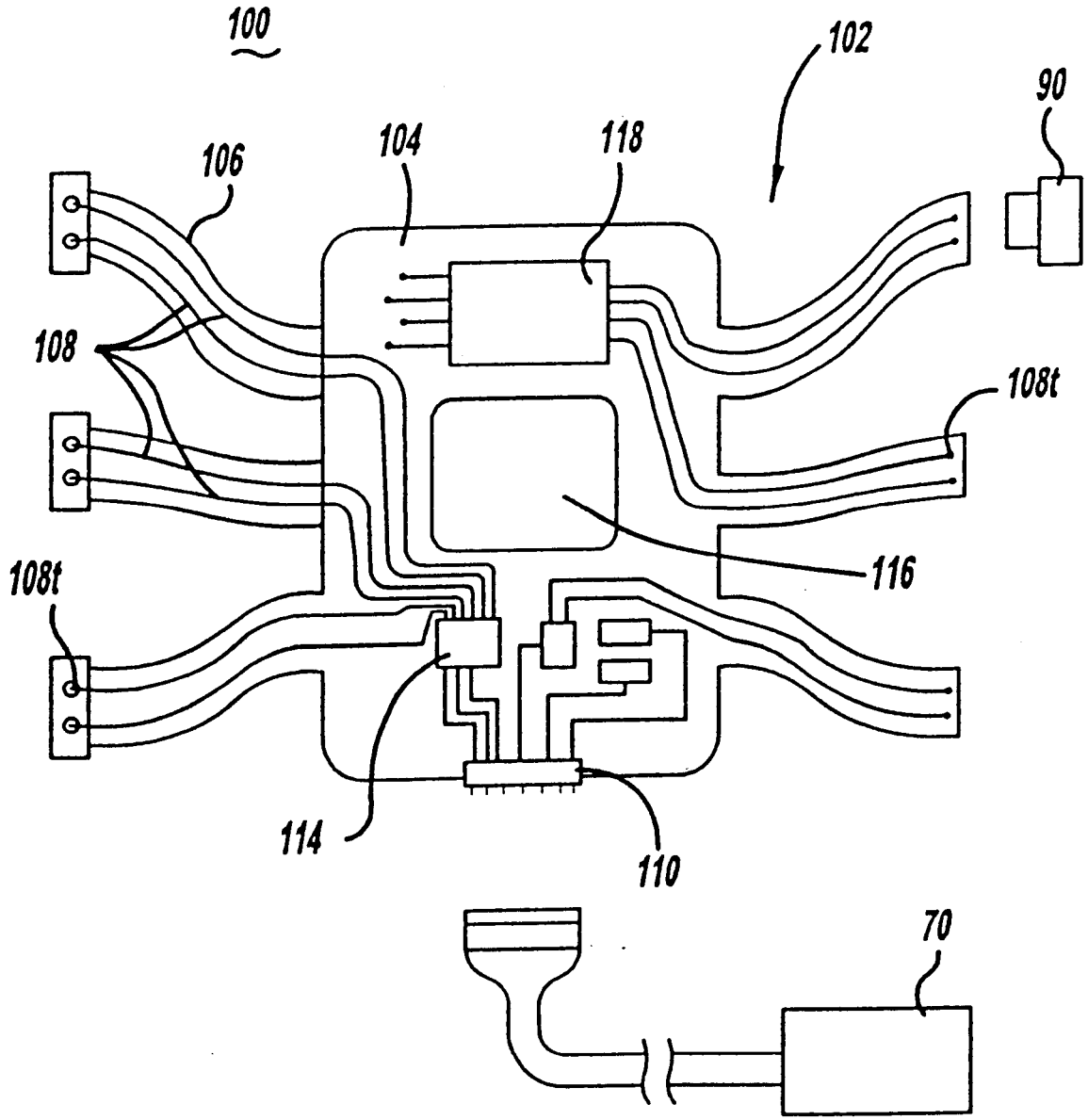
FIGS. 1–2 are top and perspective views, respectively, of an embodiment of the present invention.
Figure 2:
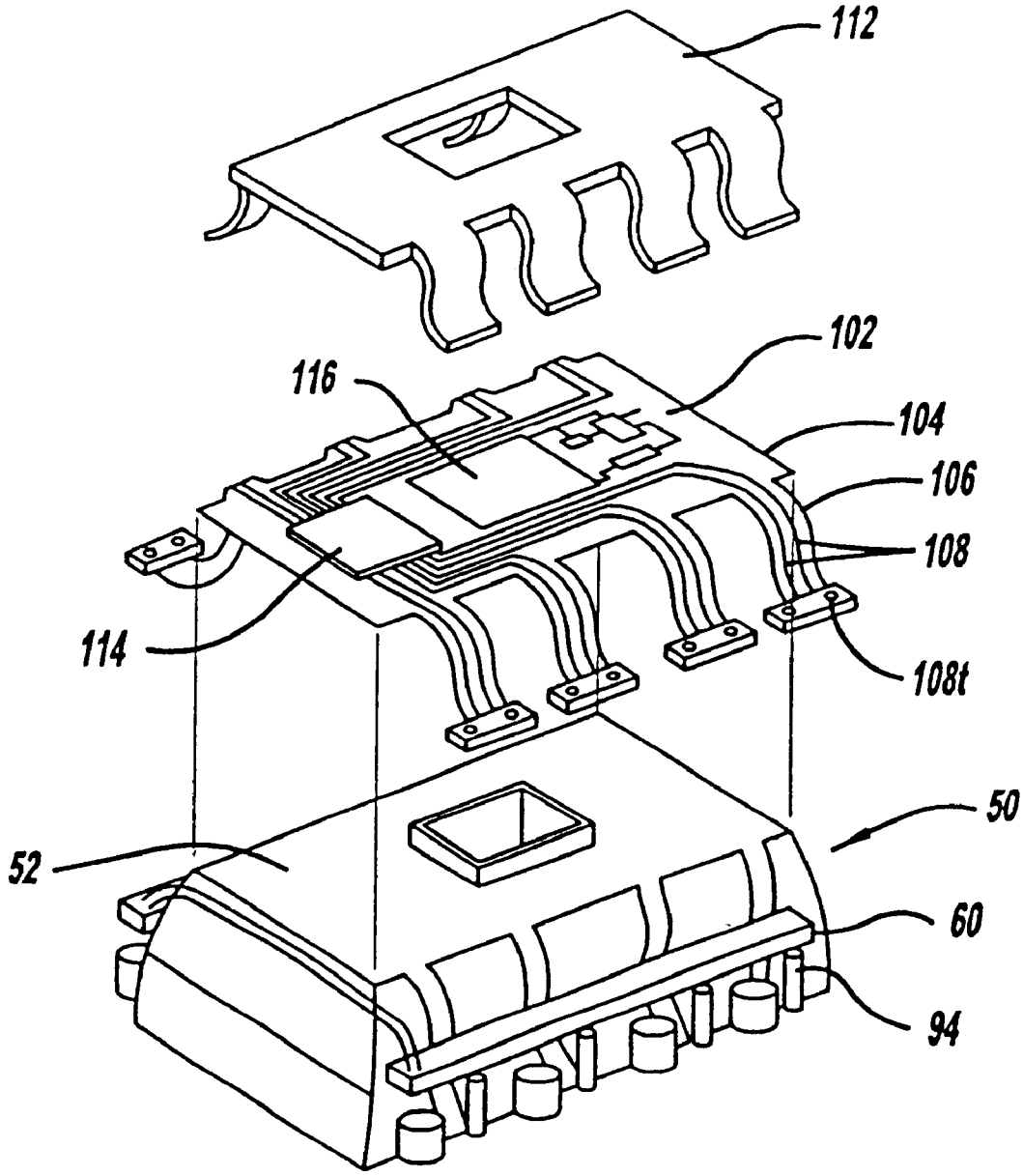
Figure 3:
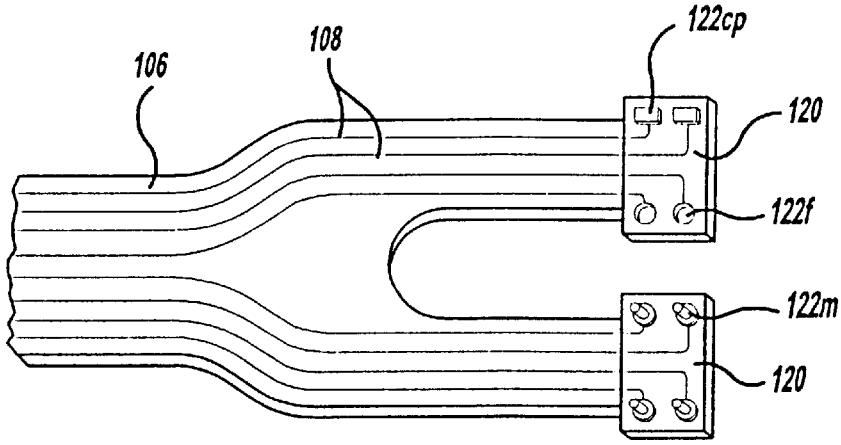
FIG. 3 is a top view of an arm portion and terminations according to an embodiment of the present invention.

Referring now to the drawings, FIGS. 1–2 show an embodiment 100 of the present invention, namely a flex circuit for routing electrical signals in an internal combustion engine (not shown) having a plurality of cylinders and an intake manifold 50. This embodiment includes: (1) a flex circuit substrate 102 having a body portion 104 and at least n arm portions 106 extending outward from the body portion, wherein the body portion generally conforms in shape with a top surface 52 of the intake manifold 50, and wherein each arm portion is arranged in general proximity with a respective cylinder; (2) a plurality of conductive circuit traces 108 arranged proximate (i.e., on or beneath/within) at least one surface of the body portion 104 and of each arm portion; and (3) at least one input/output connector 110 for connection to at least one of an external signal source, an external power source, an external signal destination, and an external power destination (collectively designated by reference numeral 70), wherein each input/output connector 110 is attached to the substrate 102 and is electrically connected to at least one of the circuit traces 108. In this embodiment, each circuit trace carried by each arm portion 106 terminates in a termination 108*t* capable of electrical connection with at least one electrical engine element 90, such as an ignition coil, an electronic fuel injector, a spark plug, and/or a glow plug.

The substrate 102 is preferably a substantially flexible substrate, such as a film, sheet, or lamination of polyetherimide, polyester, or other materials used to make flex circuits. Alternatively, the substrate 102 may comprise one or more metal foils or sheets with one or more layers of insulative, conductive, and/or dielectric material selectively applied thereto (e.g., by lamination, etching, or other additive or subtractive processes). Although the substrate 102 is preferably generally flexible, the body portion 104 may alternatively include at least one rigid substrate portion 118 (e.g., an FR-4 daughter board) operably connected to the remaining flexible body portion and/or arm portions. Likewise, the entire body portion 104 may comprise a rigid substrate, to which flexible substrate arm portions 106 are operably attached.

The substrate 102 may include a plurality of electronic components 114 operably attached to the circuit traces 108 thereon. These components 114 are preferably surface mount components, such as integrated circuit (IC) chips, leadless chip components (LCCs) such as resistors and capacitors, power devices, interconnect devices, microprocessors and the like. It is possible to take components from otherwise separate electronic control modules—including but not limited to engine control modules, mass air flow sensor modules, anti-lock brake control modules, speed control modules, throttle control modules, fuse box modules, exhaust gas return (EGR) valve control modules, engine temperature sensor control modules and integrate the components onto the flex substrate 102 of the present embodiment. This would provide the advantage of eliminating the various housings, wires, cables, harnesses, busses, interconnects, fasteners, etc. that are otherwise needed for each individual module and incorporating only the necessary parts therefrom (i.e., the electronic components) onto the flex substrate 102, thereby reducing cost, weight, space, and complexity for the overall powertrain system. Thus, the present invention provides a system and method for controlling the operation of a powertrain wherein the powertrain control electronics (PCE) are packaged integral with the powertrain or, more specifically, within the air intake manifold of the engine.

The substrate 102 may further include a hole 116 in the body portion 104 thereof, through which a top portion of the intake manifold 50 or an end portion of an air intake duct 56 may extend. The substrate 102 may also be removably attachable to the top surface 52 of the intake manifold 50. This may be accomplished, for example, by providing holes in the substrate 102 through which fasteners may be inserted for holding the substrate against the manifold, or by providing fasteners integral with the substrate which directly attach to the manifold.

Figure 5:
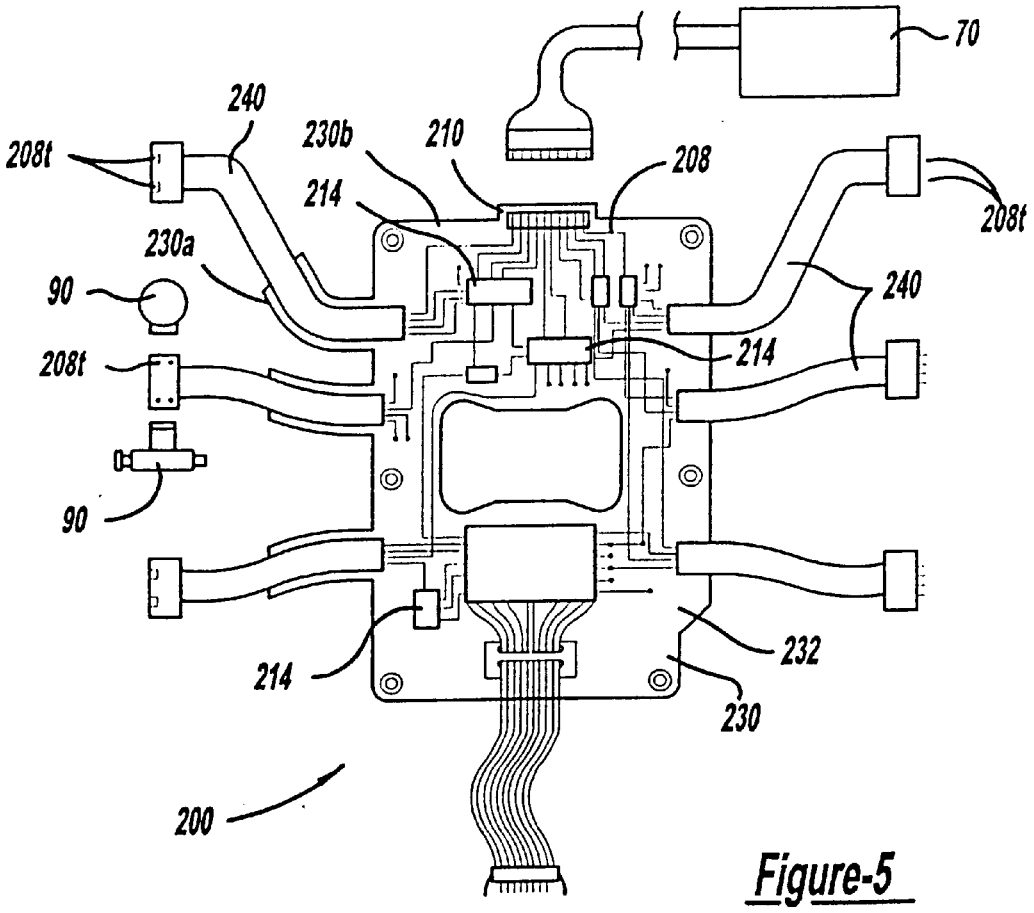
FIGS. 5–7 are top views of another embodiment of the present invention.

Each arm portion 106 may include a rigid substrate member 120 on an end thereof, wherein the termination of each circuit trace 108 on each arm portion 106 is disposed on the rigid substrate member 120, as illustrated in FIG. 5. Also, each circuit trace termination 108*t* on each arm portion 106 may comprise a male plug connector 122*m*, a female socket connector 122*f*, or a generally flat contact pad 122*cp*. These plug connectors 122*m*/122*f* may optionally be attached to or made integral with the rigid substrate member 120 on the end of each arm portion 106.

The conductive circuit traces 108 may be similar to those found on conventional rigid PCBs and flex circuits, such as the metallizations or paths of copper or conductive ink applied to one or both planar sides of such substrates. The traces 108 may also comprise wires or other electrical conductors applied to a surface of the substrate 102, or which are embedded, molded, or otherwise placed beneath a surface of the substrate (i.e., within the substrate).

The input/output (i/O) connector 110 is used to connect one or more substrate circuit trace(s) 108 (typically multiple traces) to one or more external electrical elements 70. From the perspective of current flow within the engine's electrical system, these external elements 70 may each be an "upstream" source or a "downstream" destination (or both) with respect to the i/O connector 110. The electrical flow to or from each of these external elements to which the i/O connector is connected may be generally designated as "signal" strength (e.g., milliamps, millivolts) or "power" strength (e.g., 1+amps, 1+volts). Thus, an external "power source" might be a 12-volt battery, a "power destination" might be a solenoid requiring several amps/volts to actuate, a "signal source" might be a 150-millivolt output from a microprocessor, and a "signal destination" might be a 150-millivolt input to the same microprocessor. Furthermore, it should be understood that the electrical flow into and out of the i/O connector 110 may at any time be continuous, intermittent/pulsed, or both. The i/O connector 110 itself may assume any of the multitude of different i/O connector configurations known in the art which can be operably connected to a flexible, semi-rigid/rigiflex, or rigid substrate 102.

The present embodiment may also include a cover 112 capable of covering substantially all of the body portion 104 and at least part of each arm portion 106, as shown in FIG. 2. This cover 112 may be made out of plastic, metal, fiberglass, and the like (or combinations thereof), may be removably attachable to the intake manifold 50, and serves as a protective covering for the underlying substrate, traces, etc. The cover 112 may include a generally sealable hole therein through which the top portion of the manifold or an end portion of the air intake duct may extend.

In its most basic form, the present embodiment 100 may be used to replace the wires, cables, harnesses, support frame(s), powertrain control circuits and other related elements used in conventional powertrain control systems for routing and distributing electrical signals to control the engine's ignition coils, EFIs, spark plugs, glow plugs, and/or other electrical engine elements 90, as well as, the vehicle's transmission, thus reducing cost, space, weight, and complexity for the overall engine system. By further including the electronic components from one or more engine control modules as described above, further reductions can be realized. Moreover, the savings and reductions made possible by the present invention relate not only to the initial manufacturing and assembly of the powertrain system, but also to the maintenance and service life of the powertrain system as well. As an example of how the present embodiment might be used, the flex circuit 100 might contain electronic components (including microprocessors and other integral circuits) and interconnections such that the flex circuit 100 may (1) take in signal and power from various external sources via the i/O connector 110, (2) process and/or re-route the signal/power within the flex circuit itself, and then (3) send out signal/power feeds through both the i/O connector 110 and the arm portion circuit traces to various external signal/power destinations (e.g., solenoid inputs, electric motor contacts, spark plugs, ignition coils, glow plugs, EFIs, etc.) to control the operation of the powertrain.

Figure 4A:
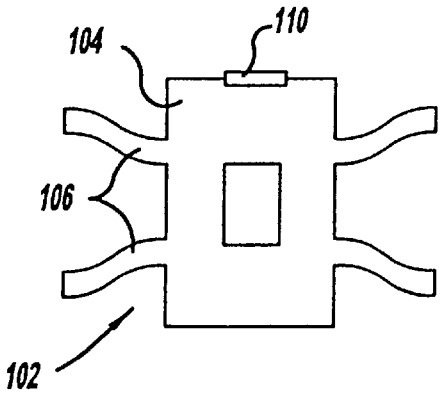
FIGS. 4*a–c* are top views of three possible configurations of an embodiment of the present invention.
Figure 4B:
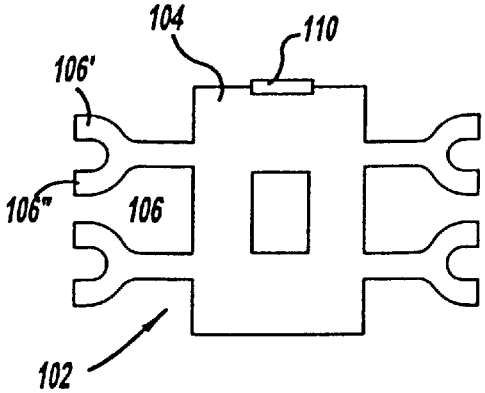
Figure 4C:
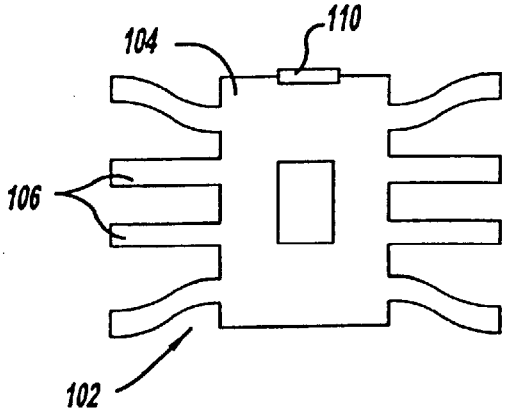

Many possible configurations exist for the present embodiment, as illustrated in FIGS. 4*a–c* for an engine having four cylinders (i.e., n=4). In a first example, as shown in FIG. 4*a*, the substrate 102 may have exactly four arm portions 106 (i.e., one for each cylinder) wherein the circuit traces (not shown) on or within each arm portion 106 have terminations capable of electrical connection with an ignition coil, an EFI, a spark plug, and/or a glow plug associated with the respective cylinder of each arm portion 106. Here, each arm portion 106 may generally conform in shape with a top runner surface 54 associated with the respective cylinder; the arm portions may then be laid atop (and optionally attached to) their respective runners and covered with a cover 112 corresponding in overall shape with the body and arm portions 104/106 as laid out atop the manifold 52 and runners 54. In a second example, as shown in FIG. 4B, the substrate 102 may have exactly four arm portions 106 with each arm dividing further into first and second branches 106'/106". In this case, circuit traces (not shown) on or within each first branch 106' have terminations (e.g., male plug connectors or female socket connectors) capable of electrical connection with an ignition coil, while circuit traces on or within each second branch 106" have terminations capable of electrical connection with an EFI. In a third example, as shown in FIG. 6*c*, the substrate 102 has 2n arm portions 106, wherein circuit traces proximate each arm portion 106 have terminations electrically connectable with one of an ignition coil, an EFI, a spark plug, and a glow plug. Many other configurations are also possible within the scope of the present invention. In any case, generally, the flex circuit substrate 102 may be draped and optionally attached onto the top surface 52 of the manifold 50, and a cover 112 as described above may then be placed over the flex circuit 102 and attached to the manifold 50.

Figure 6:
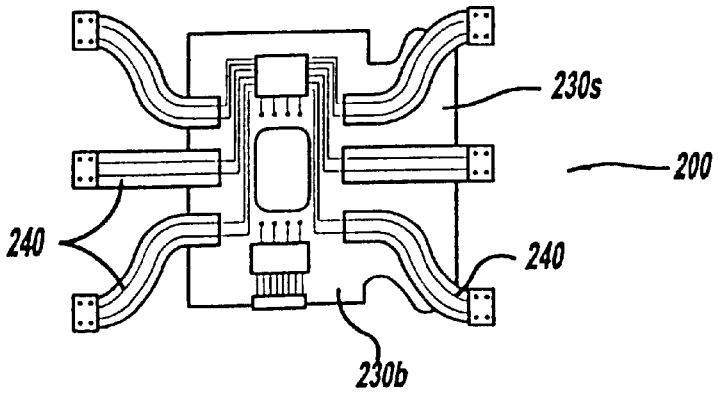
Figure 7:
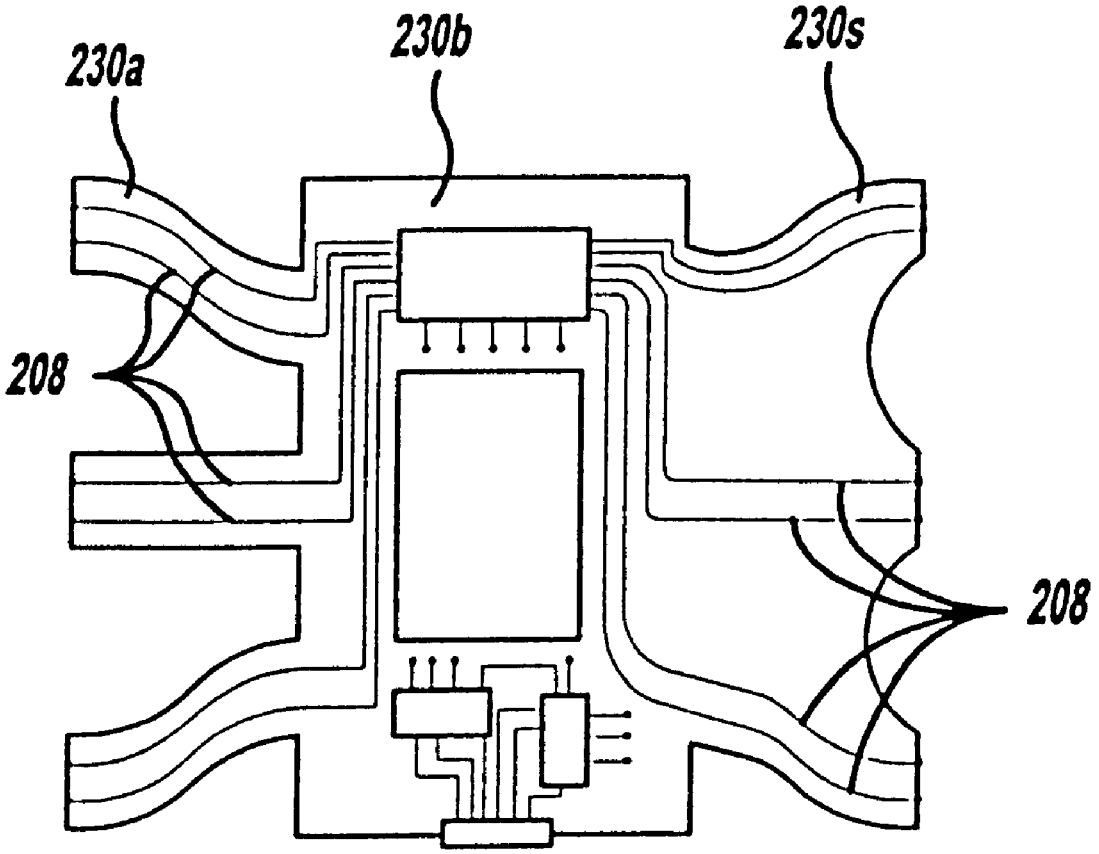

Another embodiment of the present invention relates to an intake manifold cover 200 for routing electrical signals for controlling a powertrain, wherein the powertrain has an internal combustion engine 30 having n cylinders and an intake manifold 50, as shown in FIGS. 5–7. This embodiment includes: (1) a generally rigid housing 230 generally conforming in shape with and being removably attachable to a top surface 52 of the intake manifold 50 (as shown in FIG. 2); (2) at least n carrier members 240 attached to the housing 230 and extending outward therefrom, wherein each carrier member is arranged in general proximity with a respective cylinder; (3) a plurality of conductive circuit traces 208 arranged on or beneath a surface 232 of the housing 230 and on or within each carrier member 240; and (4) at least one input/output connector 210 for connection to at least one of an external signal source, an external power source, an external signal destination, and an external power destination (designated collectively by reference numeral 70), wherein each input/output connector 210 is attached to the housing 230 and is electrically connected to at least one of the circuit traces 208. In embodiment 200, each circuit trace 208 carried by each carrier member 240 terminates in a termination 208*t* capable of electrical connection with at least one electrical engine element 90, such as an ignition coil, an EFI, a spark plug, and/or a glow plug.

Embodiment 200 combines many of the features of flex substrate 102 and cover 112 of embodiment 100, but is not a mere combination of these two elements. For example, whereas the first embodiment 100 includes a flex circuit substrate 102, the present embodiment 200 does not necessarily include a flex substrate. Instead, the traces 208 (and electronic components 214 such as integrated circuits and microprocessors operably connected thereto) of the present embodiment 200 may be directly connected to a surface 232 (preferably an underside surface) of the housing 230, thereby eliminating the need for a flex substrate. Of course, a flex substrate (and/or even a rigid substrate or substrate portion) may be included if desired; for example, the traces 208 and electronic components 214 may be attached to a flex circuit substrate, with this substrate then being attached to the underside or other surface 232 of the housing 230, or a flex circuit substrate may first be attached to the underside or other surface 232 and then the traces/components 208/214 attached thereto.

The generally rigid housing 230 may be (and preferably is) somewhat flexible. It is described as being "generally" rigid in that it should be able to generally maintain its shape when being handled (e.g., during manufacture and installation), but should have some inherent flexibility, as is the case with most thermoformed plastic parts, for example.

Like embodiment 100, embodiment 200 may assume many different but related configurations. For example, as shown in FIG. 5, each carrier member 240 may be an electrically insulative flexible substrate which carries the one or more circuit traces 208 thereon or therein. The flex substrate material in this case may be a flexible elastomer, such as silicone, or may be made of polyester, polyetherimide, or other suitable materials. These carrier members 240 may be attached to a lateral edge and/or to an underside or other surface of the housing 230 by adhesives, mechanical fasteners, in-molding, etc., and serve to carry signal/power between at least the i/O connector 210 and an electrical engine element 90 such as an ignition coil, EFI, spark plug, and/or glow plug. For example, each carrier member 240 may serve to carry signals/power from the i/O 210 and/or optional electronics 214 to an ignition coil and/or an EFI associated with the carrier member's respective cylinder.

The housing 230 may comprise a body portion 230*b* and at least n arm portions 230*a* extending outward from the body portion, wherein the body portion generally conforms in shape with top surface 52 of manifold 50, and wherein each arm portion 230*a* is arranged in general proximity with a respective cylinder, as shown on the left-hand side of the cover shown in FIG. 6. Alternatively, the housing 230 may comprise a body portion 230*b* as just described and at least one shroud portion 230*s* extending outward from the body portion on one or both lateral edges of the body portion, as shown on the right-hand side of the cover shown in FIG. 6. In either of these two housing configurations, the arm portions/shroud portions 230*a*/230*s* are preferably made integral with the body portion 230*s*, thus constituting a single piece which can be easily molded. In these two configurations each carrier member 240 is preferably attached to a corresponding arm portion 230*a* or shroud portion 230*s*, but may alternatively be attached to the body portion 230*b*.

Each carrier member 240 and/or (if provided) each arm portion 230*a* may be constructed so as to generally conform to each respective cylinder thereof. Alternatively, rather than providing separate but geometrically similar arm portions 230*a* and carrier members 240, the features of both may be combined to comprise a configuration wherein each carrier member 240 is an outwardly extending integral arm portion of the housing 230. That is, rather than having carrier members which carry circuit traces thereon or therein attached to separate, corresponding arm portions 230*a* or shroud portions 230*s*, instead the circuit traces could be carried on or within an underside (or other) surface of each arm or shroud portion 230*a*/230*s*-each arm/shroud portion would both extend outward from the body portion 230*b* and serve as a carrier for the circuit traces 208 associated with the arm portion and respective cylinder, as illustrated in FIG. 7.

Figure 8:
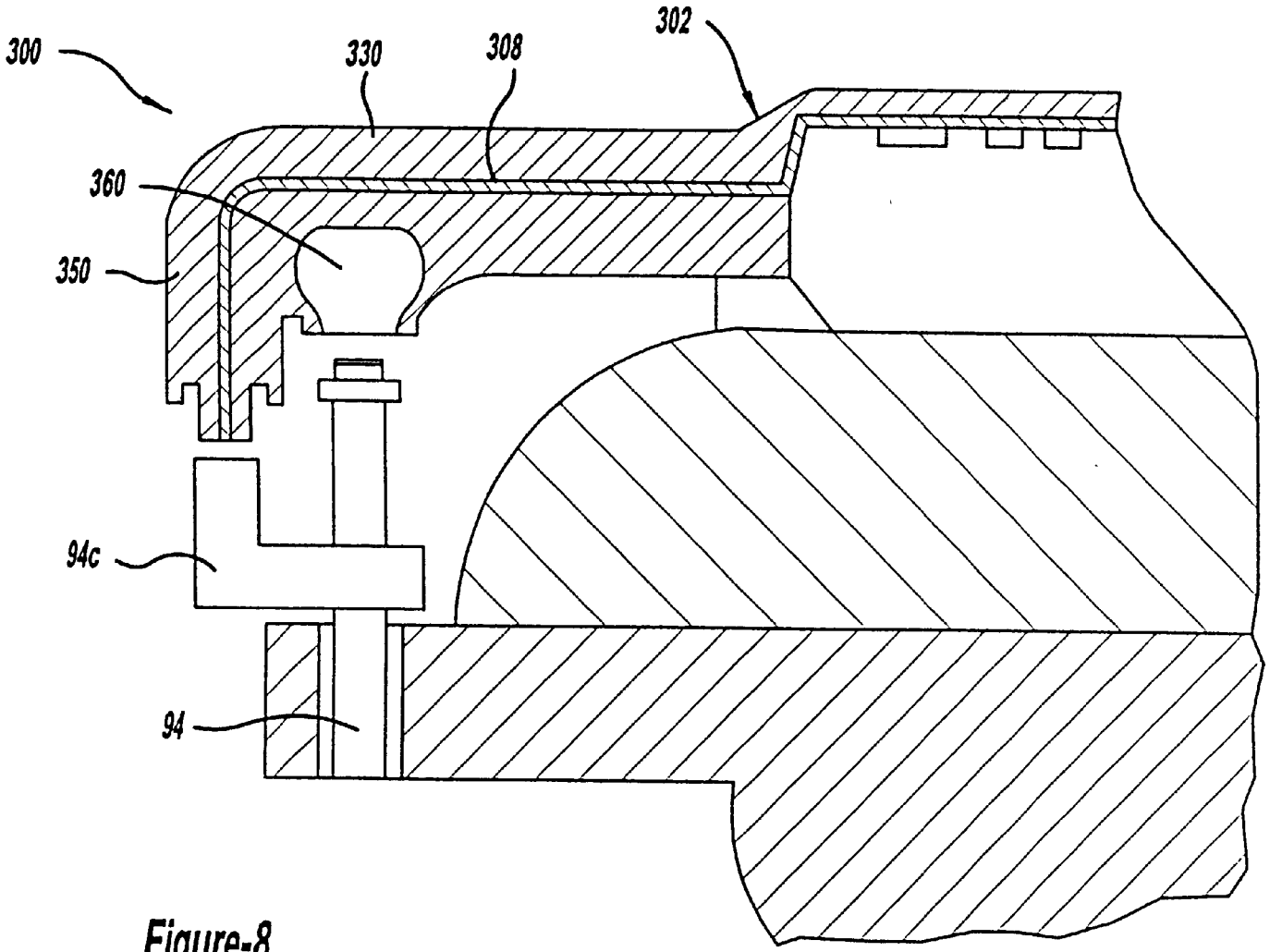
FIG. 8 is a sectional side view of yet another embodiment of the present invention.

Yet another embodiment 300 of the present invention, an intake manifold cover 302 is illustrated in FIG. 8, and includes: (1) a generally rigid housing 330 generally conforming in shape with and being removably attachable to top surface 52 of intake manifold 50, the housing 330 extending generally over each cylinder; (2) a plurality of conductive circuit traces 308 arranged on or within an underside or other surface of the housing and extending in general proximity with each cylinder; (3) at least one input/output connector for connection to at least one of an external signal source, an external power source, an external signal destination, and an external power destination, wherein each input/output connector is attached to housing 330 and is electrically connected to at least one of the circuit traces 308; and (4) at least n electrical connectors 350 in-molded in housing 330, wherein each connector 350 is connected with at least one of the circuit traces 308 and is disposed within housing 330 so as to be directly connectable with an electrical engine element, such as an electronic fuel injector 94, when housing 330 is attached to intake manifold 50. The housing portion (s) which extend over each cylinder may comprise integral arm or shroud portions, similar to FIG. 7.

As shown in FIG. 8, intake manifold cover 302 may further comprise at least one fuel rail 360 integral with the housing 330, wherein each fuel rail is directly and sealably connectable with at least one electronic fuel injector 94 so as to provide sealable fluid communication between the fuel rail and each EFI connectable thereto. Preferably, the cover 330 is made of molded plastic and includes either one fuel rail 360 for slant-type or in-line engines or two fuel rails 360 for V-type engines. The fuel rail(s) 360 may be conventional metal fuel rails that are insert molded into the housing 330, or (as shown in FIG. 8) may be metallized or non-metallized channels formed within the housing 330 by lost-core or other molding processes.

Manifold cover 302 of the present embodiment may include n electrical connectors 350 disposed within the housing 330. Each connector 350 is directly connectable with a mating electrical connector portion 94*c* of an associated electronic fuel injector 94 when the housing 330 is placed atop and attached to the intake manifold 50, for example.

At least a subset of the circuit traces 308 may be in-molded within the housing 330 and may comprise a metal stamping, a flex circuit, or a network of wires within the housing. Preferably this subset of traces are each operably connected with the at least n electrical connectors 350.

One advantage of the present embodiment is that the cover 300 may be fitted over and attached to the manifold 50 with the aforementioned electrical connectors 350 fitting directly over their respective electrical engine elements 90. For example, a cover may have connectors 350 in-molded therein which may simultaneously mate directly with the mating electrical connector portions of n ignition coils and n fuel injectors when the cover is lowered onto and attached to the manifold 50, without requiring additional steps or interconnecting components (e.g., wire harnesses or cables) for connecting the coils and EFIs with their power/signal sources. Adding the fuel rails 360 as described above further reduces complexity and installation effort.

Figure 9A:
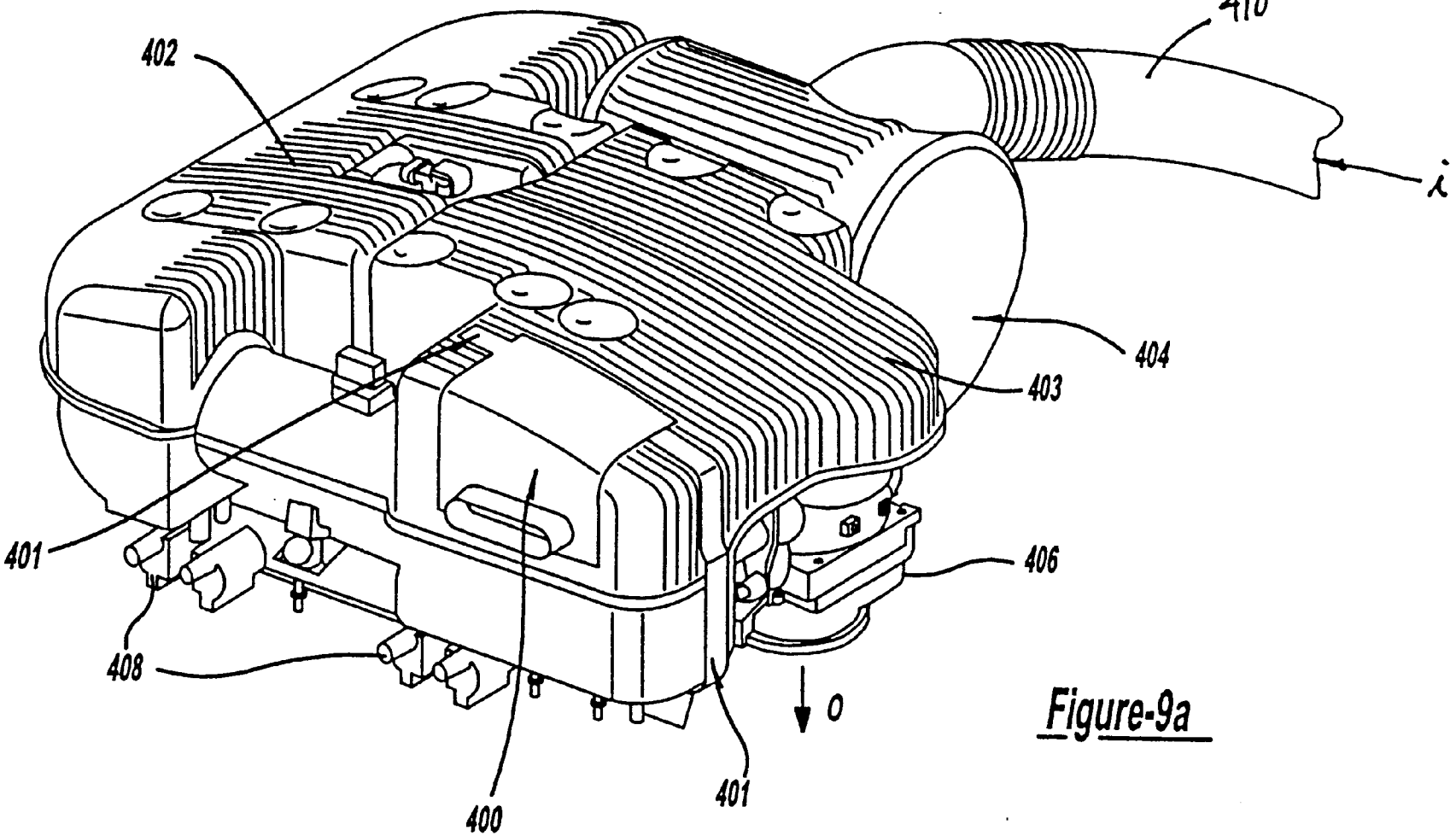
FIGS. 9*a–c* are perspective views of an intake manifold having an integrated powertrain control circuitry attached thereto, in accordance with the present invention.
Figure 9B:
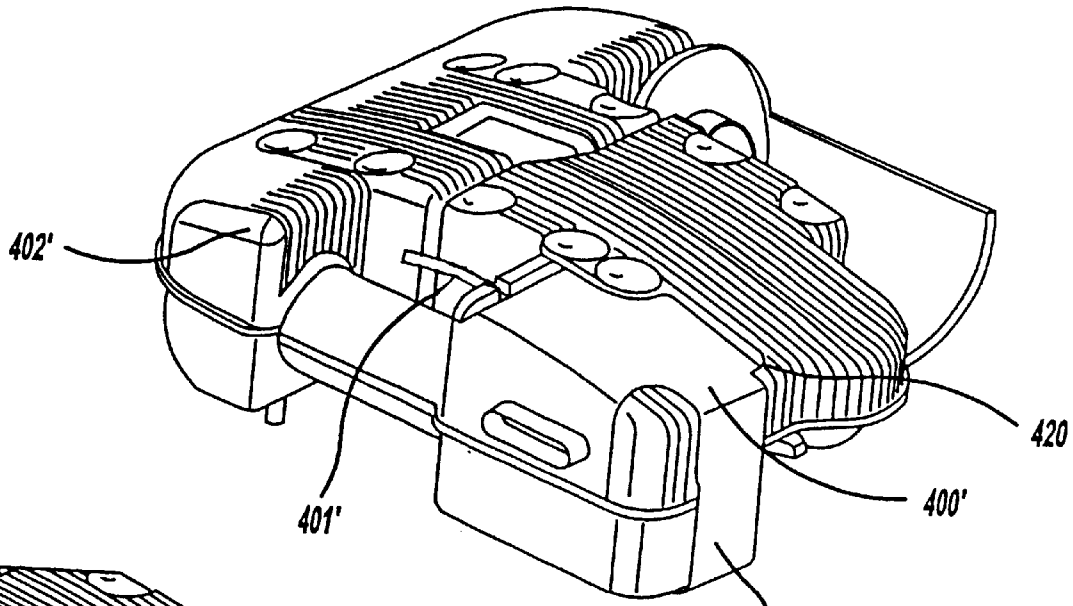
Figure 9C:
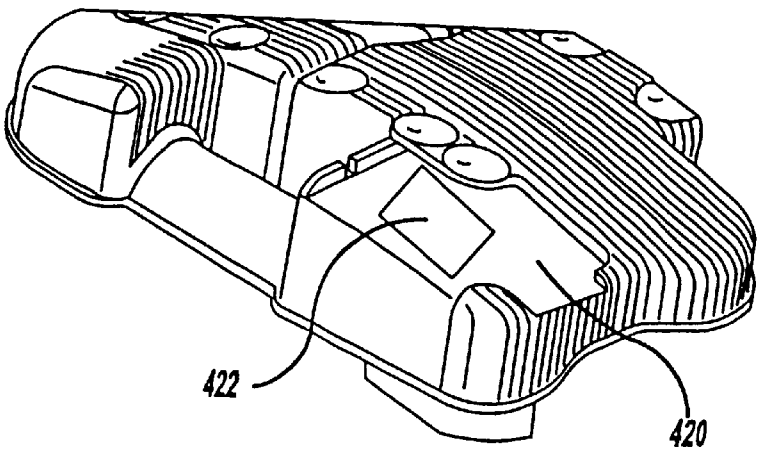

Referring now to FIGS. 9*a*–9*c*, a preferred embodiment of the present invention is illustrated. A flat wire substrate 400 having a plurality of discrete and integrated circuit components (not shown) mounted thereon for controlling the operation of a powertrain is shown mounted to a portion of an air intake manifold 402. As is well know in the art, air intake manifold 402 includes an air filter housing 404, a throttle body 406, and coils on plugs 408. In operation, outside air is drawn into intake tube 410 and is filtered by an air filter (not shown) contained within air filter housing 404 and directed into intake manifold 402 via air ducts and passages (not shown) and through throttle body 406 for supplying the engine with the appropriate air fuel mixture. The direction of air flow into and out of the intake manifold 402 and throttle body 406 is generally indicated by arrows i and O.

Substrate 400 operatively includes control circuitry for controlling the operation of a vehicle's powertrain. Control circuitry, by definition, may include discrete electrical components, integrated circuits, microprocessors and logic devices. Further, control logic may be implemented in substrate 400 using the aforementioned discrete components and/or software programming code.

Flatwire substrate 400 is bonded to a top surface 403 of manifold 402 using an adhesive or similar attachment means including screws and/or rivets. A plurality of flat wire leads 401 extend from substrate 400 to electrically couple and carry electrical signals to and from electrical devices and/or sensors, such as injectors, coils and mass air-flow sensors.

In FIGS. 9*b* and 9*c* another embodiment of an integrated manifold 402' is illustrated. Integrated manifold 402' has a lower manifold portion 462 and upper manifold portion 464 which are joined along a weld-line 440. Manifold 402' has a flatwire flexible substrate 400' contained within a recess 420. Recess 420 improves the overall packageability of manifold 402' within a vehicle's engine compartment. As in previous embodiments, substrate 400' includes a plurality of flatwire leads 401' for operatively interfacing substrate 400' with the electrical devices and sensors for carrying out powertrain control.

Preferably, a heatsink 422 is disposed within recess 420 for contacting a bottom surface of substrate 400' for thermally dissipating and cooling substrate 400'. Heatsink 422 is preferably made from a highly thermally conductive metal for improved heat dissipation of substrate 400'.

Figure 10A:
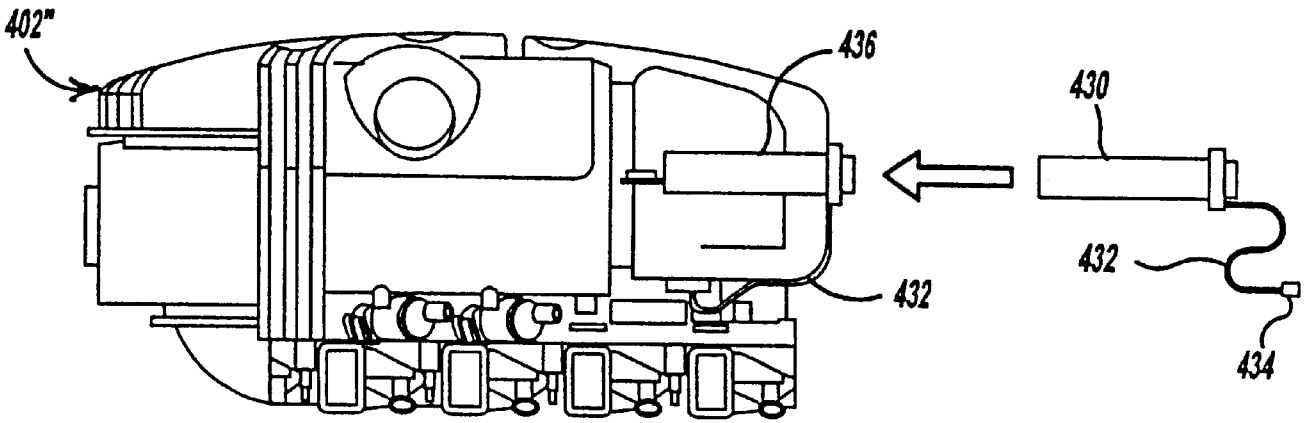
FIGS. 10*a–b* are a side and perspective views of an intake manifold having an integrated powertrain control module housed therein, in accordance with an embodiment of the present invention.

Referring now to FIG. 10*a*, an integrated intake manifold 402" is shown in accordance with still another embodiment present invention, in which a powertrain control module (PCM) or housing 430 is removably attached to manifold 402. PCM 430 includes a flatwire flexible substrate 484 (shown in FIG. 11*b*) having electronics for processing engine operating signals and outputting powertrain control signals to control the operation of the powertrain. PCM 430 communicates with various sensors and engine sub-systems using flexible takeouts or leads 432 having connectors 434. As described in previous embodiments, the flexible takeouts or leads 432 may be integral to the flexible substrate 484 or the takeouts may be soldered to the substrate. As shown in FIG. 10*a*, PCM 430 is housed within the interior of intake manifold 402, preferably, in the path of flowing intake air. This configuration provides maximum cooling and environmental protection for PCM 430.

Figure 10B:
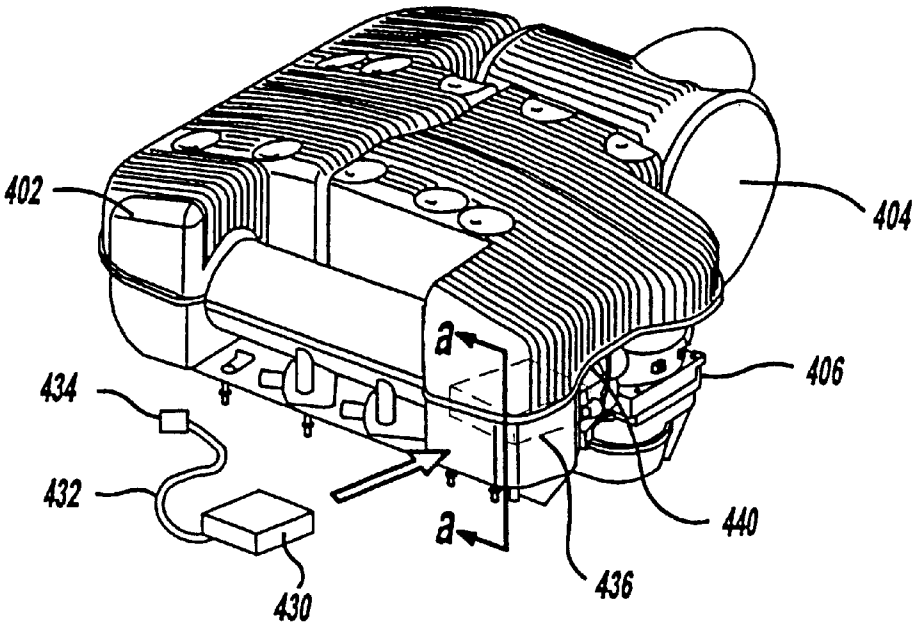

Referring now to FIG. 10*b*, a perspective view of air intake manifold 402" is illustrated having an alternate housing cavity 436, in accordance with the present invention. PCM 430 may be housed in various locations within intake manifold 402". However, housing cavity 436 is provided along weld-line 440 for ease of manufacturing. Of course, the selection of the precise location of housing cavity 436 within air-intake manifold 402" is governed by the specific vehicle application as well as cooling and environmental requirements.

Figure 11A:
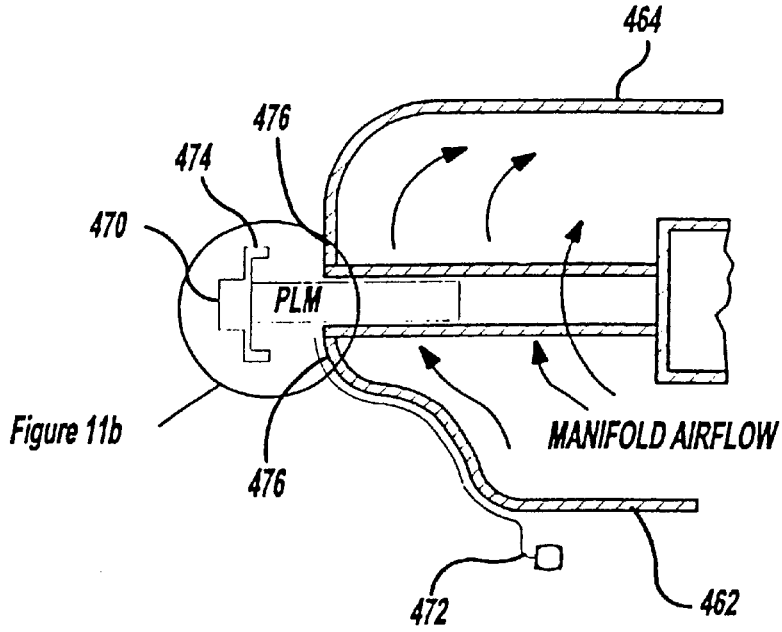
FIG. 11*a* is a cross-sectional view through the powertrain integrated module circuitry of the intake manifold, in accordance with the present invention.

FIG. 11*a* is a cross-sectional view an through intake manifold 402", PCM 430 and housing cavity 436 as indicated in FIG. 10*b*, in accordance with the present invention. As illustrated cavity 436 is defined by internal support rails 460 which may be integral with lower manifold portion 462 and upper manifold portion 464. Alternatively, interior support rail 460 may be separate plastic or metal pieces which are affixed to the interior portions of intake manifold 402" for supporting PCM 430. As will be illustrated in subsequent views, support rails 460 are configured to hold and support PCM 430 while allowing air to flow over and through the rails and around PCM 430 to maximize convective cooling of the electronics housed within module 430.

Figure 11B:
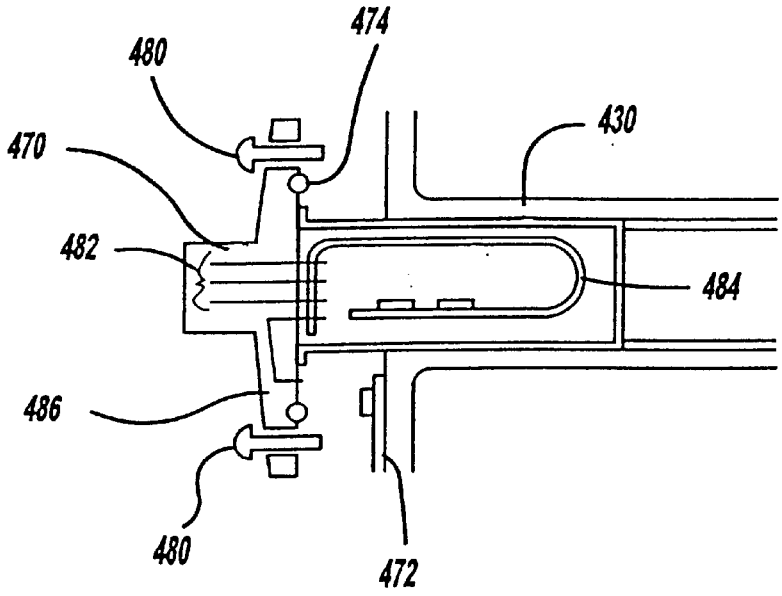
FIG. 11*b* is a magnified view of the cross-sectional view of FIG. 11*a*, in accordance with the present invention.

With reference to FIGS. 11*a* and 11*b*, PCM 430 is shown having a connector 470 for electrically coupling the electronics housed within PCM 430 to flexible circuit takeouts 472 which are routed along the exterior of intake manifold 402". Connector 470 includes a water-tight seal or gasket 474 for providing an environmental seal between connector 470 and an exterior surface 476 of intake manifold 402". As further illustrated in the magnified view in FIG. 11*b*, connector 470 mounted to PCM module 430 may be attached to and sealingly matted with intake manifold 402" using conventional screws 480 or other known attachment schemes.

As shown in FIG. 1*b*, connector 470 includes a plurality of connector pins or electrical traces or features 482 for interconnecting flexible substrate 484 contained within PCM 430 with external circuits and systems. For example, interconnect feature 486 may be provided to electrically couple substrate 484 to selected circuits or takeouts 472 which are exterior to PCM 430 and or routed along an exterior of manifold 402". To increase heat conduction through PCM 430, substrate 484 is preferably bonded to PCM module 430 using a thermal adhesive 490. Flatwire takeouts 472 may for example, run to connectors on the bottom of manifold 402" and interconnect with an in molded lead frame (not shown) in lower manifold portion 462.

Figure 12A:
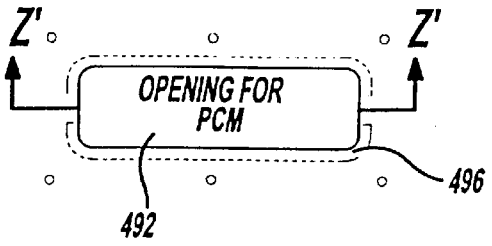
FIGS. 12*a–b* are end views the module opening/cavity of the intake manifold, in accordance with the present invention.

FIG. 12*a* is an end view of integrated intake manifold 402" illustrating an opening 492 of cavity 436. In an embodiment the support shelves for constraining PCM 430 are an upper shelf 494 and a lower shelf 496. The support shelves 494 and 496 may be integrally molded with the manifold housing, or can be separate pieces (made from plastic, metal, etc.) that are attached to the housing or in-molded therein.

Figure 12B:
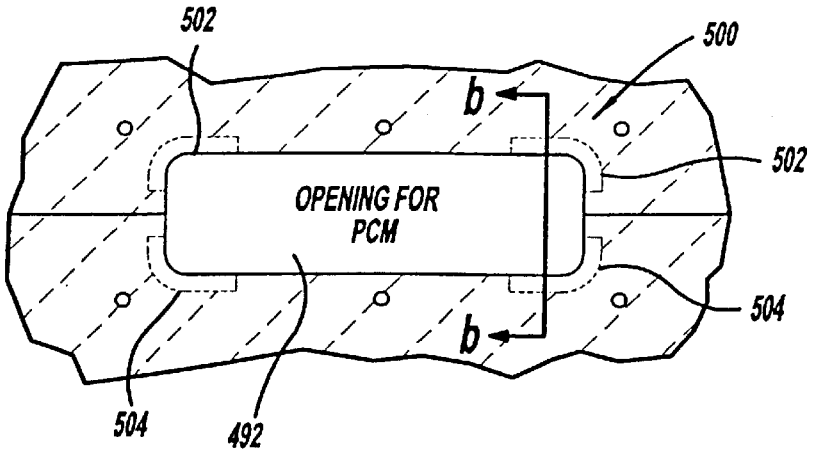

FIG. 12*b* is an end view of integrated intake manifold 402" illustrating an opening 492 of cavity 436. In this embodiment the support rails 500 for constraining PCM 430 include a pair of upper rails 502 and a pair of lower rails 504. The support rails 500, as with the support shelves described above, may be integrally molded with the manifold housing, or can be separate pieces (made from plastic, metal, etc.) that are attached to the housing or in-molded therein.

Figure 13A:
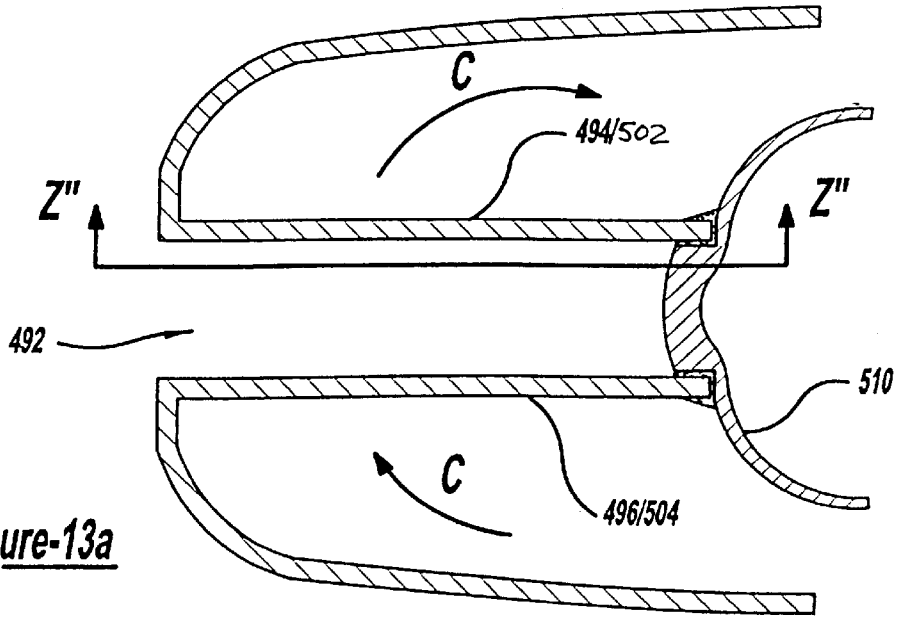
FIGS. 13*a–c* are various cross-sectional views through the module opening/cavity of the intake manifold as indicated in FIGS. 12*a–b* and 13*a*, in accordance with the present invention.

Referring now to FIG. 13*a*, a cross-sectional view of manifold 402 as indicated in FIG. 12*b* as view bb is illustrated. In this embodiment, support shelves or rails are attached to an inner manifold wall 510 during manifold assembly. Air flows through and over shelves/rails and PCM 430, as indicated by arrows c, to provide sufficient cooling of the PCM.

Figure 13B:
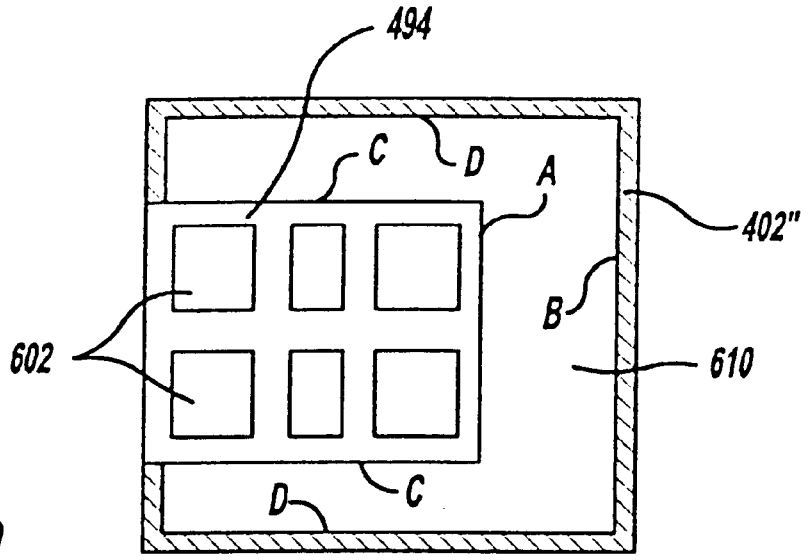
Figure 13C:
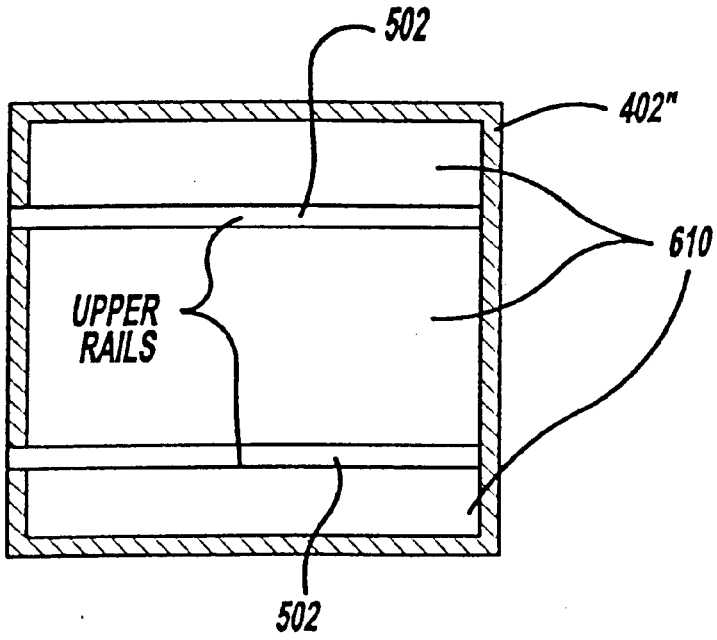

Referring now to FIGS. 13*b* and 13*c*, detailed views z' and z" as indicated in FIGS. 12*a* and 13*a* of support shelves or rails are further illustrated, in accordance with the present invention. FIG. 13*b* shows only an upper shelf 494, however, lower shelf 496 of the same configuration would be disposed directly below the upper shelf. Upper shelf 494 includes a plurality of apertures 602 for allowing air to flow therethrough. Edge A of upper shelf may optionally extend to and become integral with edge B of manifold 402". Likewise, edges C may optionally extend to and become integral with edges D of manifold 402".

Alternatively, as shown in FIG. 13*c*, upper rails 502 are provided for supporting PCM 430 and are integrally attached or in-molded in manifold 402". A set of lower rails 504 (not shown) would also be provided below upper rails 502 for further supporting module 430. Upper and lower rail configurations provide large air passages 610 for allowing air to flow therethrough.

Various other modifications to the present invention will, no doubt, occur to those skilled in the art to which the present invention pertains. For example, although only V-type engines are shown in the drawings, the present invention also relates to slant-type engines, in-line engines, rotary engines, etc. It should also be understood that the present invention relates to both gasoline and diesel internal combustion engines, as well as to hybrid electric/internal combustion engines. The present invention applies to engines using spark plugs, glow plugs, or compression-ignition-only; to those having carburetors, EFIs, or other related systems; and to those having central distributors, coil-on-plug, and other related spark activation systems. Furthermore, while the arm portions, shroud portions, and carrier members have been described above as being connected to or integral with a cover, housing, or body portion, it is within the scope of the present invention that the arm portions, shroud portions, and carrier members may be removably connectable with their associated cover, housing, or body portion, such as by using mating male/female electrical connectors. Also, the housing or cover may include louvers, vanes, and the like for directing some amount of air from the air intake duct across the circuit traces and optional electronic components, so as to assist in cooling these elements during operation. Moreover, it should be understood that while the arm portions and carrier members have variously been described as being connected to ignition coils, EFIs, spark plugs, and glow plugs, it is contemplated that other electrical engine elements may be used instead of or in addition to these four highlighted elements, such as engine sensors, climate sensors, solenoids, switches, etc., whether sending or receiving signals to or from the present invention. Additionally, it should be understood that the use of the word "signal" as variously used herein may encompass both relatively low voltage/low amperage triggering signals and relatively high voltage/high amperage power feeds, whether sent/received in intermittent pulses or in continuous non-pulsed form. Finally, the present invention further includes a flex circuit similar to the above described embodiments, but which has no arm portions, or less than n arm portions, and which may not necessarily include any element which is generally proximate to or related with any engine cylinder. It is the following claims, including all equivalents which define the scope of the present invention.

What is claimed is:

1. A system for controlling a vehicle powertrain, the system comprising:

a powertrain circuit for receiving a plurality of powertrain operating signals, processing the powertrain operating signals, and outputting a plurality of powertrain control signals for controlling the vehicle powertrain;

an air-intake manifold fixable to an engine of the vehicle powertrain and adapted to receive the powertrain control circuit;

a housing for supporting the powertrain circuit, wherein the housing is substantially disposed within an interior of the air-intake manifold.

2. The system of claim 1, wherein the powertrain circuit is a flatwire flexible circuit.

3. The system of claim 2, wherein the flatwire flexible circuit further comprises a flatwire lead for electrically coupling the powertrain circuit to an external device or circuit.

4. The system of claim 1, wherein the powertrain circuit further comprises a processor for processing powertrain control logic for controlling powertrain operation.

5. The system of claim 1, wherein the air-intake manifold further comprises a heat sink fixed to the air-intake manifold for increasing thermal cooling of the powertrain circuit.

6. An air-intake manifold fixable to an engine of a vehicle powertrain for directing intake air into the engine, the manifold comprising:

a powertrain circuit disposed within the air intake manifold for receiving a plurality of powertrain operating signals, processing the operating signals, and outputting a plurality of powertrain control signals for controlling the vehicle powertrain.

7. The system of claim 1 wherein the housing is substantially disposed within an air stream flowing through the manifold for convectively cooling the powertrain circuit.

8. The system of claim 1 wherein the powertrain circuit is adhesively bonded to the housing with a thermally conductive adhesive.

9. The system of claim 1 wherein the air-intake manifold further comprises a shelf for supporting the housing within an interior of the manifold.

10. The system of claim 9 wherein the shelf is integrally molded with the manifold.

11. The system of claim 1 wherein the air-intake manifold further comprises at least two rails for supporting the housing within an interior of the manifold.

12. The system of claim 11, wherein the rails are integrally molded with the manifold.

13. The system of claim 1 wherein the housing further comprises an electrical connector affixed to the housing for electrically coupling the powertrain circuit to a circuit or device external of the housing.

14. The air-intake manifold of claim 6, wherein the powertrain circuit is a flatwire flexible circuit.

15. The air-intake manifold of claim 14, wherein the flatwire flexible circuit further comprises a flatwire lead for electrically coupling the powertrain circuit to an external device or circuit.

16. The air-intake manifold of claim 6, further comprising a housing for securing the powertrain circuit thereto and providing environmental protection thereof.

17. The air-intake manifold of claim 16, wherein the housing is substantially disposed within an interior of the manifold and in an air-stream flowing through the manifold for convectively cooling the powertrain circuit.

18. The air-intake manifold of claim 16, wherein the powertrain circuit is adhesively bonded to the housing with a thermally conductive adhesive.

19. The air-intake manifold of claim 16, wherein the air-intake manifold further comprises a shelf for supporting the housing within an interior of the manifold.

20. The air-intake manifold of claim 19, wherein the shelf is integrally molded with the manifold.

21. The air-intake manifold of claim 16, wherein the air-intake manifold further comprises at least two rails for supporting the housing within an interior of the manifold.

22. The air-intake manifold of claim 21, wherein the rails are integrally molded with the manifold.

23. The air-intake manifold of claim 16 wherein the housing further comprises an electrical connector affixed to the housing for electrically coupling the powertrain circuit to a circuit or device external of the housing.

24. The air-intake manifold of claim 6, wherein the powertrain circuit further comprises a processor for processing powertrain control logic for controlling powertrain operation.

25. The air-intake manifold of claim 6, further comprising a heat sink fixed to the air-intake manifold for increasing thermal cooling of the powertrain circuit.

* * * * *